US009197015B2

(12) United States Patent
Tanaka et al.

(10) Patent No.: US 9,197,015 B2
(45) Date of Patent: Nov. 24, 2015

(54) CONNECTOR

(71) Applicant: Japan Aviation Electronics Industry, Limited, Tokyo (JP)

(72) Inventors: Yukitaka Tanaka, Tokyo (JP); Chikara Kawamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/105,880

(22) Filed: Dec. 13, 2013

(65) Prior Publication Data

US 2014/0187075 A1 Jul. 3, 2014

(30) Foreign Application Priority Data

Dec. 27, 2012 (JP) ..... 2012-285503

(51) Int. Cl.
*H01R 13/627* (2006.01)
*H01R 13/639* (2006.01)

(52) U.S. Cl.
CPC ..... *H01R 13/6275* (2013.01); *H01R 13/639* (2013.01)

(58) Field of Classification Search
CPC ..... H01R 13/6272
USPC ..... 439/352, 483
See application file for complete search history.

(56) References Cited

U.S. PATENT DOCUMENTS 5,938,466 A * 8/1999 Suzuki ..... H01R 13/635 439/352
6,019,629 A * 2/2000 Ito ..... H01R 13/635 439/352
6,254,400 B1 7/2001 Yodogawa
6,447,170 B1 9/2002 Takahashi et al.
6,641,425 B1 11/2003 Wu
7,134,914 B1 11/2006 Wu (Continued)

FOREIGN PATENT DOCUMENTS

CN 1220505 A 6/1999
CN 1574495 A 2/2005

(Continued)

OTHER PUBLICATIONS

Japanese Office Action dated Nov. 7, 2013 in Japanese Application No. 2012-285503 with English translation.

(Continued)

*Primary Examiner* — Abdullah Riyami
*Assistant Examiner* — Thang Nguyen
(74) *Attorney, Agent, or Firm* — Collard & Roe, P.C.

(57) ABSTRACT

A connector includes a spring portion, a lock member and a movable member. When the movable member is forced to be moved from a non-operation position to an operation position, an operation portion of the movable member operates an operated portion of the lock member to move a lock portion of the lock member from a lock position to an unlock position. When the movable member is held at the operation position, a front end of the spring portion presses a pressed portion of the movable member to move the movable member towards the non-operation position. When the movable member is released, the movable member is moved back from the operation position to the non-operation position so that the operation portion stops to operate the operated portion to move the lock portion back to the lock position.

11 Claims, 12 Drawing Sheets

(56) References Cited

U.S. PATENT DOCUMENTS

| | | | | |
|---|---|---|---|---|
| 7,347,633 | B2 | 3/2008 | Minota | |
| 7,354,292 | B1 | 4/2008 | Lloyd et al. | |
| 7,473,124 | B1 | 1/2009 | Briant et al. | |
| 7,540,755 | B1 * | 6/2009 | Wu | H01R 13/6275 439/352 |
| 7,588,454 | B2 * | 9/2009 | Nakata | H01R 13/6277 439/352 |
| 7,591,664 | B2 | 9/2009 | Nomiyama et al. | |
| 2004/0214469 | A1 * | 10/2004 | Wu | H01R 13/6335 439/483 |

FOREIGN PATENT DOCUMENTS

| | | | | | |
|---|---|---|---|---|---|
| JP | 2001-015212 | A | | 1/2001 | |
| JP | 2001-035594 | A | | 2/2001 | |
| JP | 2003-249307 | A | | 9/2003 | |
| JP | 2005-235545 | A | | 9/2005 | |
| JP | 2005235545 | A | * | 9/2005 | H01R 13/639 |
| JP | 2009-123627 | A | | 6/2009 | |
| JP | 2009-543296 | A | | 12/2009 | |

OTHER PUBLICATIONS

Chinese Office Action dated Jul. 8, 2015 in CN 201310722078.X with English translation.

* cited by examiner

CONNECTOR

CROSS REFERENCE TO RELATED APPLICATIONS

An applicant claims priority under 35 U.S.C. §119 of Japanese Patent Application No. JP2012-285503 filed Dec. 27, 2012.

BACKGROUND OF THE INVENTION

This invention relates to a connector including a lock portion which locks mating of the connector with a mating connector.

For example, JP A 2005-235545 discloses a connector with a lock portion. As shown in FIGS. 23 and 24, the connector of JP A 2005-235545 includes a housing, a lock lever and a slide member, wherein the lock lever is formed as a part of the housing, and the slide member is able to slide within the housing. A locking hook is provided at an end of the lock lever. When the slide member is positioned towards the rear end of the connector, the lock lever extends obliquely downwards and forwards, and the locking hook is positioned within the housing. When the slide member is moved towards the front end of the connector, the slide member pushes the lock lever up so that the locking hook projects beyond the upper surface of the housing. When the slide member is positioned towards the front end of the connector while the connector is mated with a mating connector, the locking hook is received in a locking hole of the mating connector so that the mating of the connector with the mating connector is locked. When the slide member is moved towards the rear end of the connector, the lock lever returns to its initial state so that the locking hook goes out of the locking hole. Thus, the lock of the mating is released.

In the connector of JP A 2005-235545, the lock lever is provided as a part of the housing. In consideration of a general housing made of resin, a spring characteristic of the lock lever might deteriorate. If the spring characteristic of the lock lever deteriorates, the locking hook do not come within the housing even when the slide member is moved towards the rear end of the connector. In other words, the connector of JP A 2005-235545 has a problem that the lock of the mating cannot be released properly due to deterioration of the lock lever over time.

SUMMARY OF THE INVENTION

It is therefore an object of the present invention to provide a connector which can properly release a lock of mating of the connector with a mating connector.

One aspect of the present invention provides a connector which comprises a spring portion, a lock member and a movable member. The spring portion has a front end and a rear end in a front-rear direction. The front end is a free end, while the rear end is a fixed end. The lock member includes a lock portion and an operated portion. The lock portion is movable between a lock position and an unlock position. The lock portion is moved when the operated portion is operated. The lock portion locks mating of the connector with a mating connector when the lock portion is positioned at the lock position. The lock portion allows the connector to be released from the mating connector when the lock portion is positioned at the unlock position. The movable member is movable between an operation position and a non-operation position in the front-rear direction. The movable member includes a pressed portion intersecting the front-rear direction and an operation portion for operating the operated portion. The operation position is rearward of the non-operation position. When the movable member is forced to be moved from the non-operation position to the operation position, the operation portion operates the operated portion to move the lock portion from the lock position to the unlock position. When the movable member is held at the operation position, the front end of the spring portion presses the pressed portion to move the movable member towards the non-operation position. When the movable member is released, the movable member is moved back from the operation position to the non-operation position so that the operation portion stops to operate the operated portion to move the lock portion back to the lock position.

When the movable member is moved, the operation portion operates the operated portion of the lock member so that the lock portion can be moved. Thus, according to one aspect of the present invention, the lock portion can be moved intentionally. Therefore, lock of mating of the connector with a mating connector can be released surely.

An appreciation of the objectives of the present invention and a more complete understanding of its structure may be had by studying the following description of the preferred embodiment and by referring to the accompanying drawings.

Figure 1:
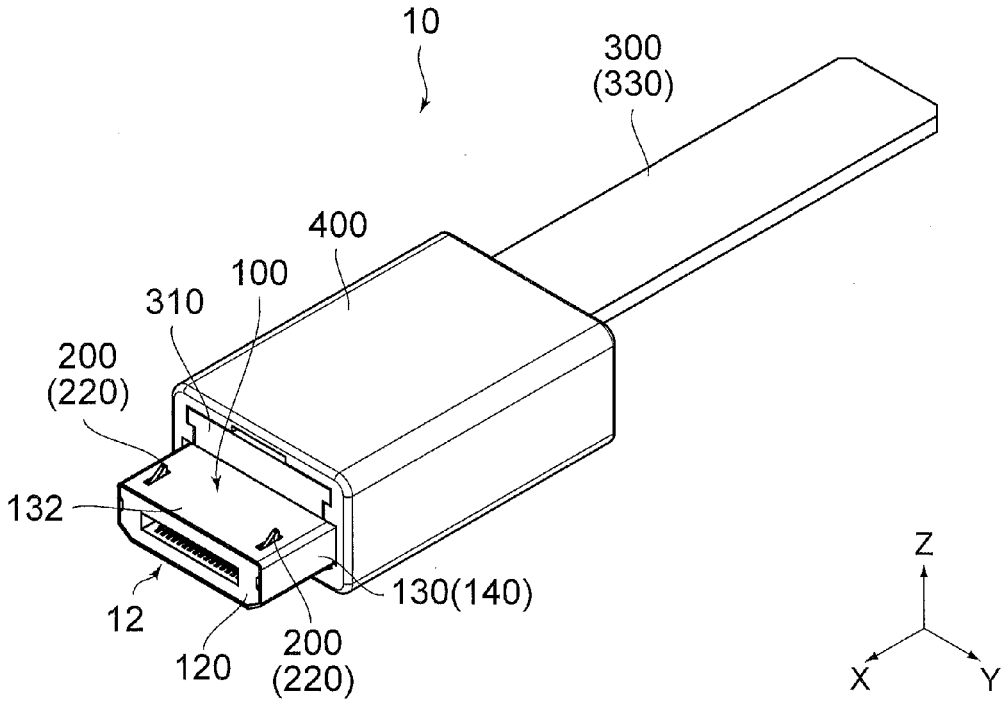
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIGS. 1 to 9, a connector 10 according to an embodiment of the present invention has a mating portion 12 which is positioned at a front end of the connector 10. The connector 10 comprises a connector main 100, a tab 300 made of insulator, and a hood (holder member) 400 made of insulator.

The connector main 100 has a main function of the connector 10, namely, a function to be mated and connected with a mating connector (not shown). In detail, as understood from FIGS. 8 to 11, the connector main 100 comprises a plurality of contacts 110 each made of conductor, a housing 120 made of insulator, a shield member 130 made of metal, and lock members 200 each made of metal.

Figure 2:
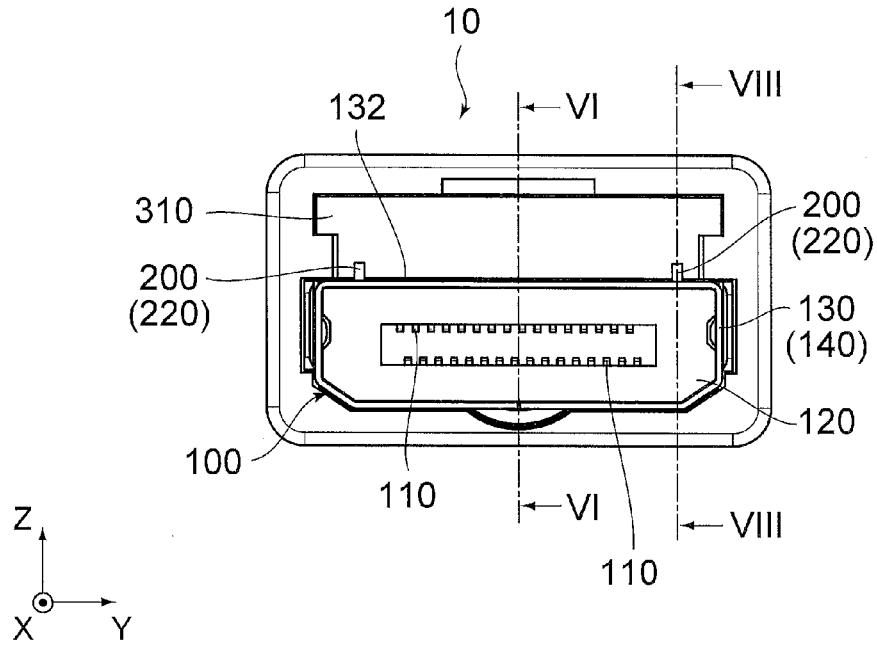
FIG. 2 is a front view showing the connector of FIG. 1.
Figure 3:
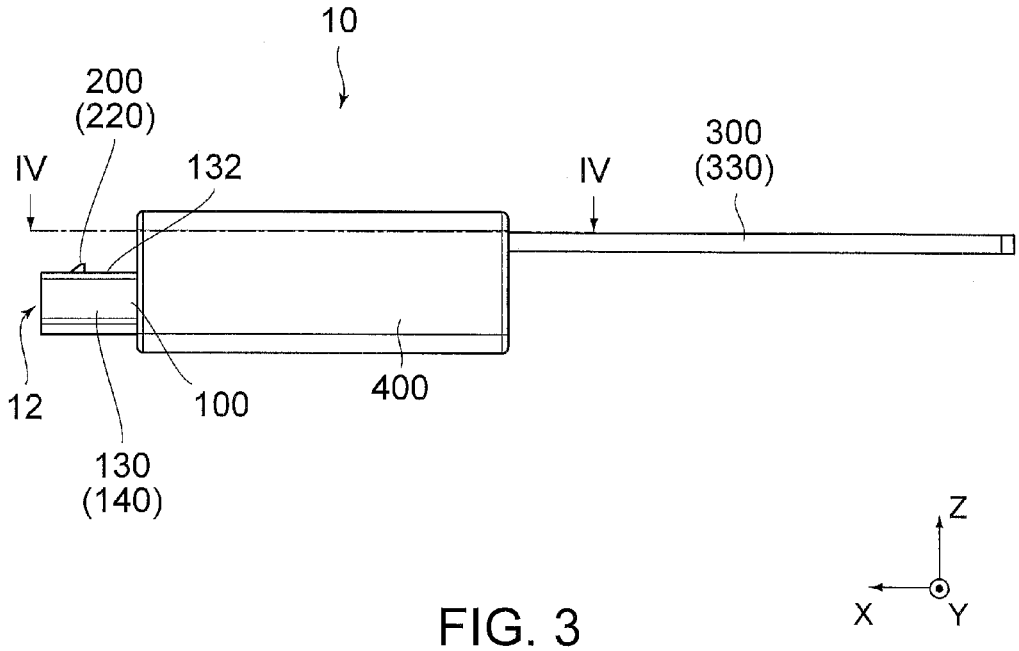
FIG. 3 is a side view showing the connector of FIG. 1.

As best shown in FIG. 2, the contacts 110 are grouped into two rows. The housing 120 holds the contacts 110 so that each row of the contacts 110 is arranged in a width direction (Y-direction).

Figure 10:
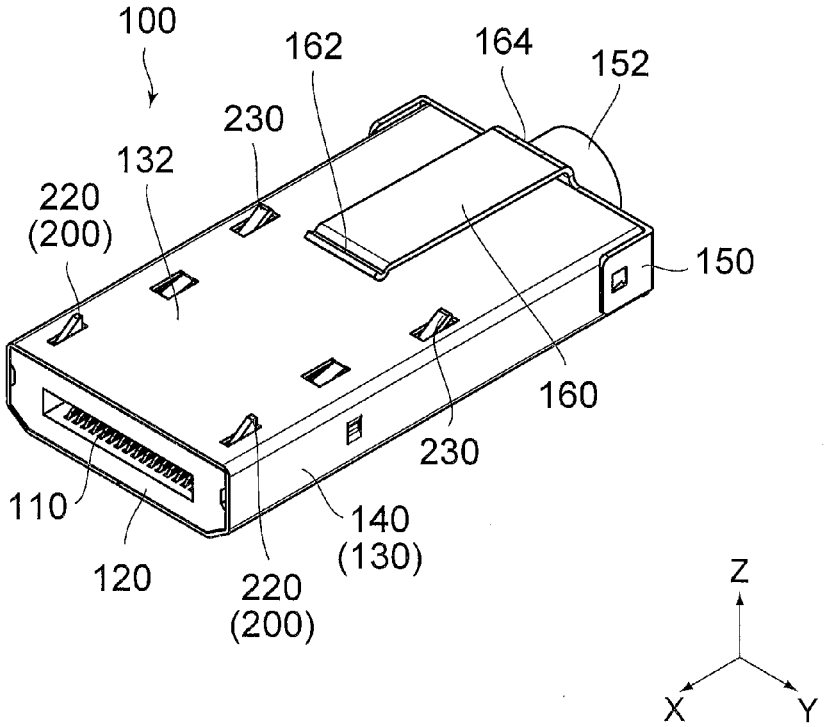
FIG. 10 is a perspective view showing a connector main which is included in the connector of FIG. 1.

As best shown in FIG. 10, the shield member 130 of the present embodiment includes a main section 140 and a subsection 150. The main section 140 has a rectangular tube-like shape and covers the housing 120 in a plane perpendicular to a front-rear direction (X-direction), or YZ-plane. The subsection 150 is attached to a rear end, or the negative X-side end, of the main section 140. The illustrated shield member 130 covers almost all of the connector main 100. Therefore, the connector 10 of the present embodiment has a superior shield characteristic.

The subsection 150 of the shield member 130 is formed integrally with a spring portion 160 and a cable clamp portion 152. The spring portion 160 has a plate-like shape and extends forward, or in the positive X-direction. The illustrated spring portion 160 is positioned outside of the main section 140. Therefore, it is not required to keep a space for resilient deformation of the spring portion 160 within the connector main 100. The connector main 100 as such can be prevented from being upsized.

The cable clamp portion 152 is used to be swaged on an outer insulator of a cable (not shown) to be fixed thereon. If a cable is a shield cable (not shown), the cable clamp portion 152 is swaged on a shield line (not shown) of the shield cable so that the cable clamp portion 152 can establish a shield connection between the shield member 130 and the shield line.

In detail, the spring portion 160 is provided over an upper surface, or the positive Z-side surface, of the main section 140. Namely, the spring portion 160 is provided over an upper surface 132, or a predetermined surface, of the shield member 130. A front end 162 of the spring portion 160 is a free end, and a rear end 164 of the spring portion 160 is a fixed end. Thus, the front end 162 of the spring portion 160 is movable. The spring portion 160 of the present embodiment has a width, or a size in the Y-direction, which is 30% or more of another width, or another size in the Y-direction, of the connector main 100. Therefore, the spring portion 160 has a strong spring force.

Although the illustrated spring portion 160 is formed of a single section, the present invention is not limited thereto. The spring portion may be formed of two or more sections. If a spring portion formed of two or more sections has a total width which is 30% or more of the width of the connector main 100, the spring portion as a whole can have a strong spring force, as mentioned above.

Figure 8:
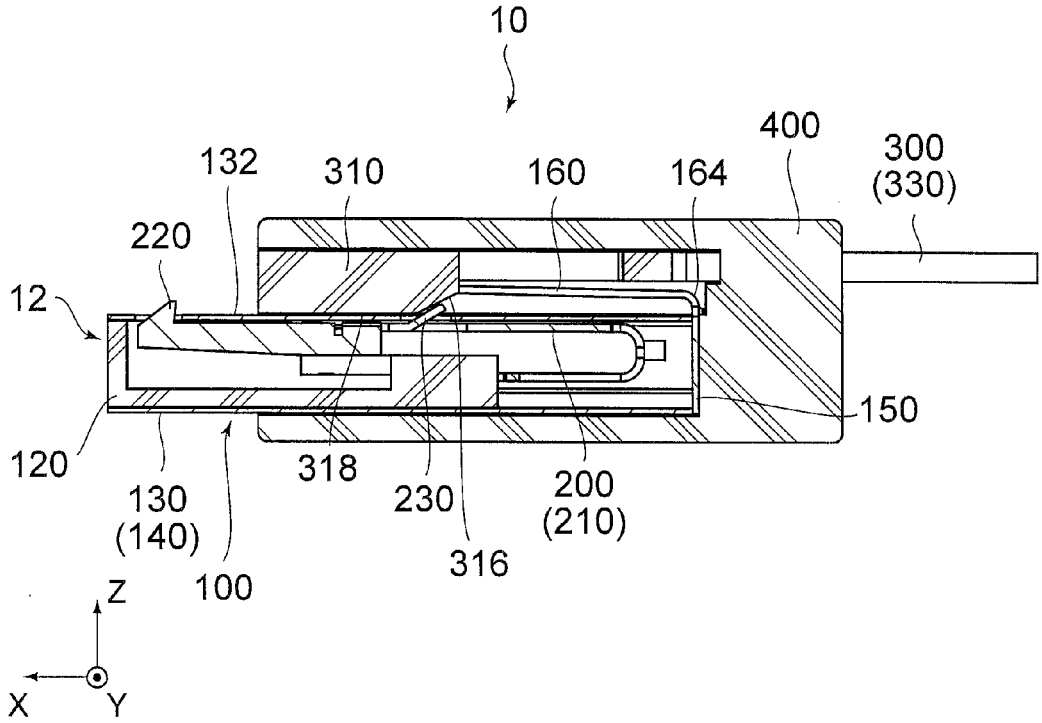
FIG. 8 is a cross-sectional view showing the connector of FIG. 2, taken along line VIII-VIII. The illustrated movable member is positioned at the non-operation position.
Figure 9:
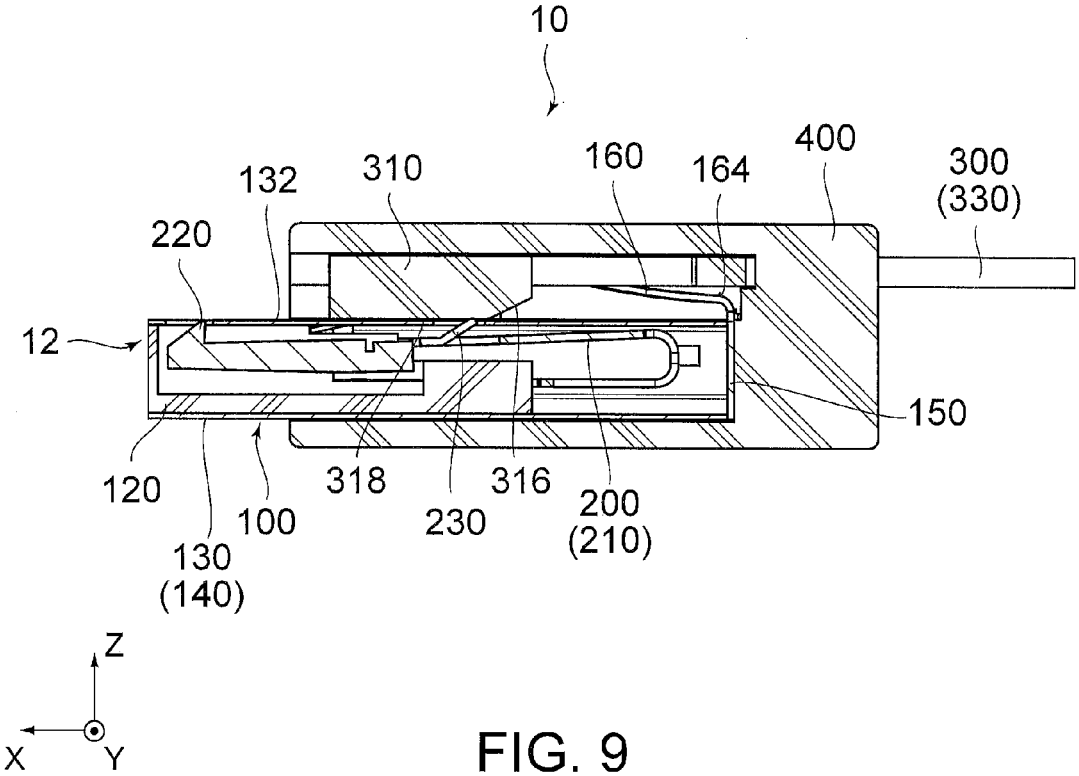
FIG. 9 is another cross-sectional view showing the connector of FIG. 8. The illustrated movable member is positioned at the operation position.
Figure 11:
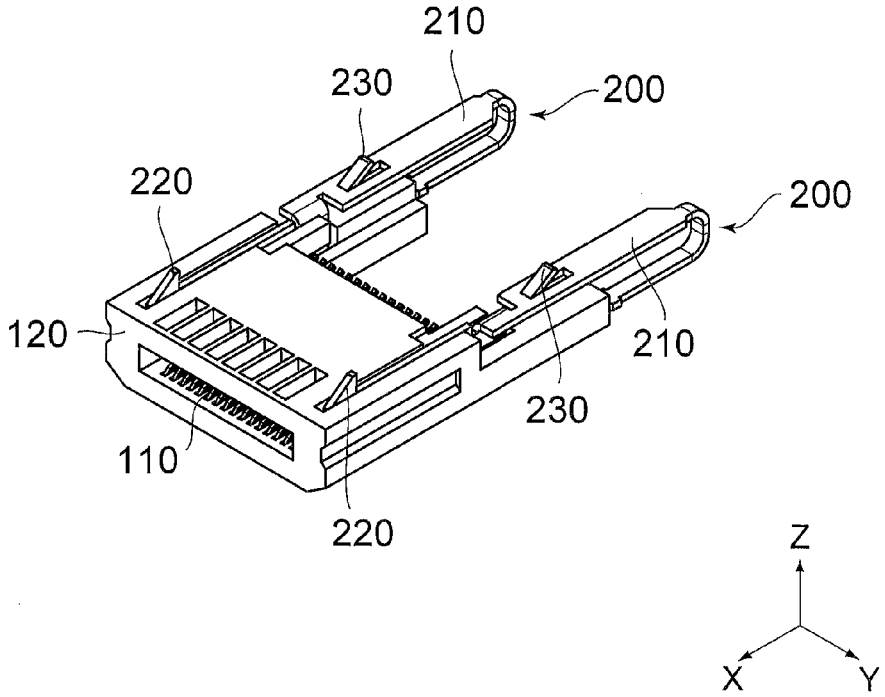
FIG. 11 is a perspective view showing the connector main of FIG. 10, wherein a shield member is omitted.

As best shown in FIG. 11, the number of the lock members 200 is two, and the lock members 200 are arranged so that the rows of the contacts 110 are positioned between the lock members 200 in the width direction. As shown in FIGS. 8, 9 and 11, each of the lock members 200 includes a resilient supporter 210, a lock portion 220 and an operated portion 230. The resilient supporter 210 is a main portion of the lock member 200. The resilient supporter 210 has a bent portion at its rear end to have a J-like shape. The resilient supporter 210 has a resilient characteristic. The resilient supporter 210 is press-fit into and held by the housing 120. The lock portion 220 and the operated portion 230 project upwards, or in the positive Z-direction, from the resilient supporter 210.

Since both the lock portion 220 and the operated portion 230 project upwards, pressing of the operated portion 230 downwards causes downward movement of the lock portion 220. Specifically, the lock portion 220 is provided at a front end of the resilient supporter 210, and the operated portion 230 is positioned rearwards, or towards the negative X-side, in comparison with the lock portion 220. Therefore, a small movement of the operated portion 230 can result in a large movement of the lock portion 220.

The lock portion 220 is supported by the resilient supporter 210 so as to be movable between a lock position and an unlock position. As shown in FIG. 10, both the lock portion 220 and the operated portion 230 project upwards beyond the upper surface 132 of the shield member 130 when the lock portion 220 is positioned at the lock position. The resilient supporter 210 presses up the lock portion 220 towards the lock position by using its resilient force. Thus, the resilient supporter 210 biases the lock portion 220 so as to move the lock portion 220 towards the lock position. In other words, the lock portion 220 constantly receives, from the resilient supporter 210, a force directed from the unlock position towards the lock position.

As shown in FIG. 9, when the operated portion 230 is pressed downwards, the lock portion 220 is moved downwards, too, so that the lock portion 220 is retracted in the shield member 130, i.e. the lock portion 220 does not project beyond the upper surface 132 of the shield member 130. At that time, a position of the lock portion 220 is the unlock position. In the present embodiment, when the lock portion 220 does not project from the upper surface 132 of the shield member 130, the operated portion 230 does not project from the upper surface 132 of the shield member 130, too. However, the present invention is not limited thereto. The operated portion 230 may project from the upper surface 132 of the shield member 130 even when the lock portion 220 is positioned at the unlock position, if possible in consideration of relation with other components.

When the connector 10 is mated with the mating connector (not shown), the lock portion 220 is positioned at the lock position. When the lock portion 220 is positioned at the lock position, the lock portion 220 locks, in cooperation with a locked portion (not shown) of the mating connector, mating of the connector 10 with the mating connector. When the lock portion 220 is moved to the unlock position, the mating is unlocked so that the connector 10 can be released from the mating connector.

As best shown in FIG. 10, all of the lock portions 220, the operated portions 230 and the spring portion 160 are arranged towards or near the upper surface 132 of the shield member 130. In other words, all of the lock portions 220, the operated portions 230 and the spring portion 160 are arranged towards or near a common surface of the shield member 130. Therefore, upsizing of the connector 10 can be prevented.

As shown in FIGS. 1 to 9, the hood 400 holds the connector main 100 so as not to allow a relative movement of the connector main 100 to the hood 400. Namely, the connector main 100 cannot be moved relative to the hood 400. On the other hand, the hood 400 holds the tab 300 so as to allow a relative movement of the tab 300 to the hood 400 in the front-rear direction. Namely, the tab 300 can be moved relative to the hood 400.

Figure 12:
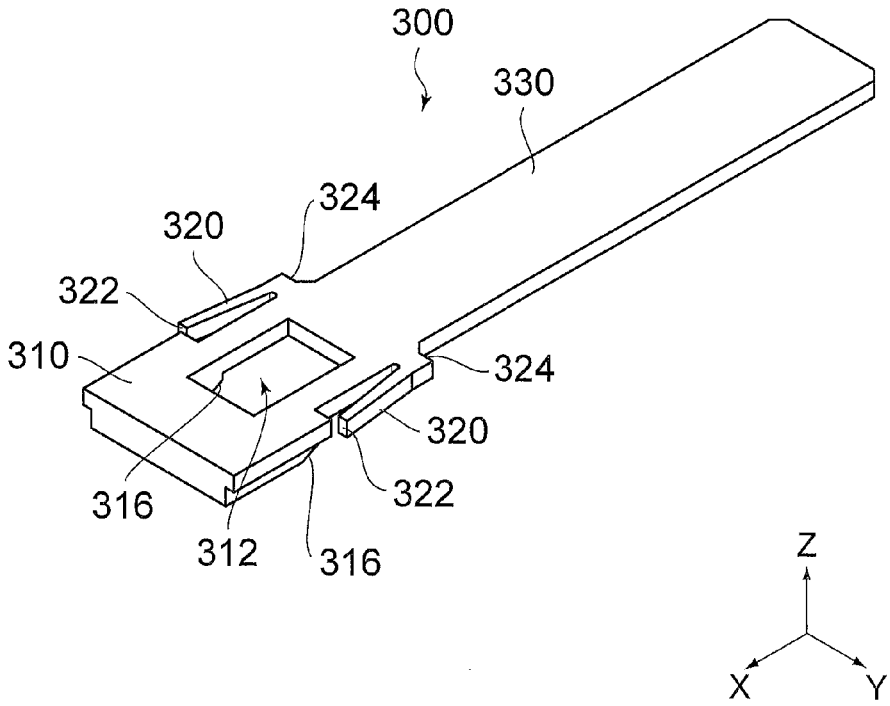
FIG. 12 is a top oblique view showing a tab which is included in the connector of FIG. 1.
Figure 13:
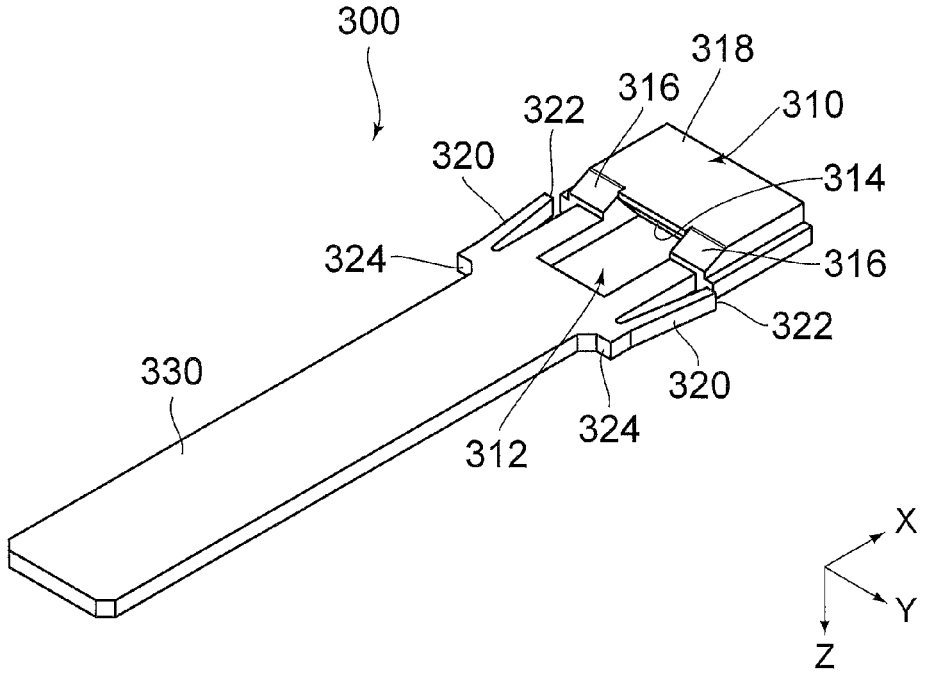
FIG. 13 a bottom oblique view showing the tab of FIG. 12.
Figure 14:
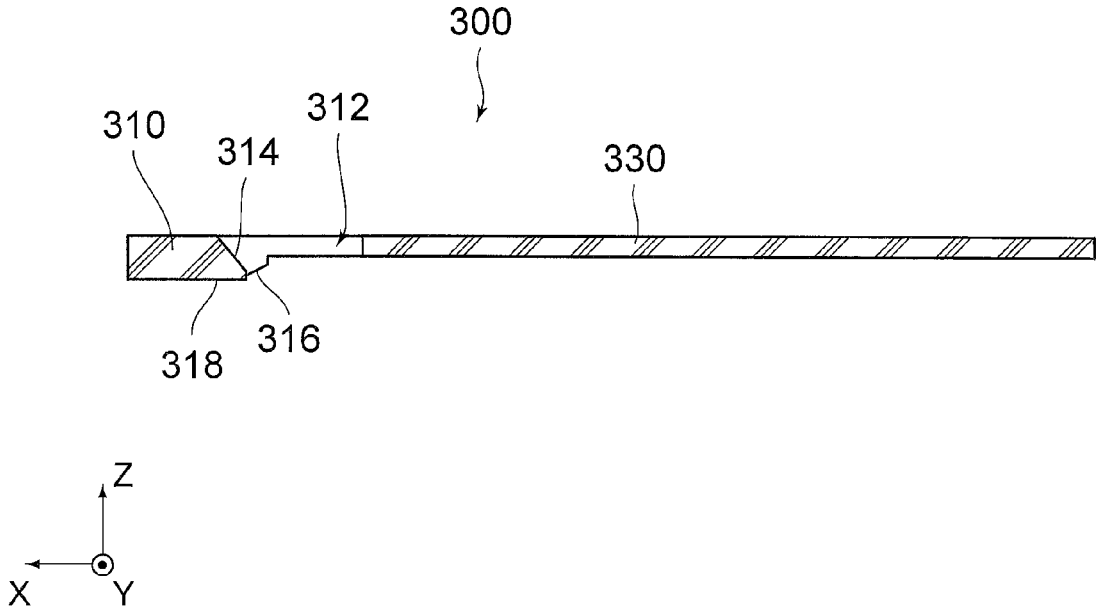
FIG. 14 is a cross-sectional view showing the tab of FIG. 12.
Figure 15:
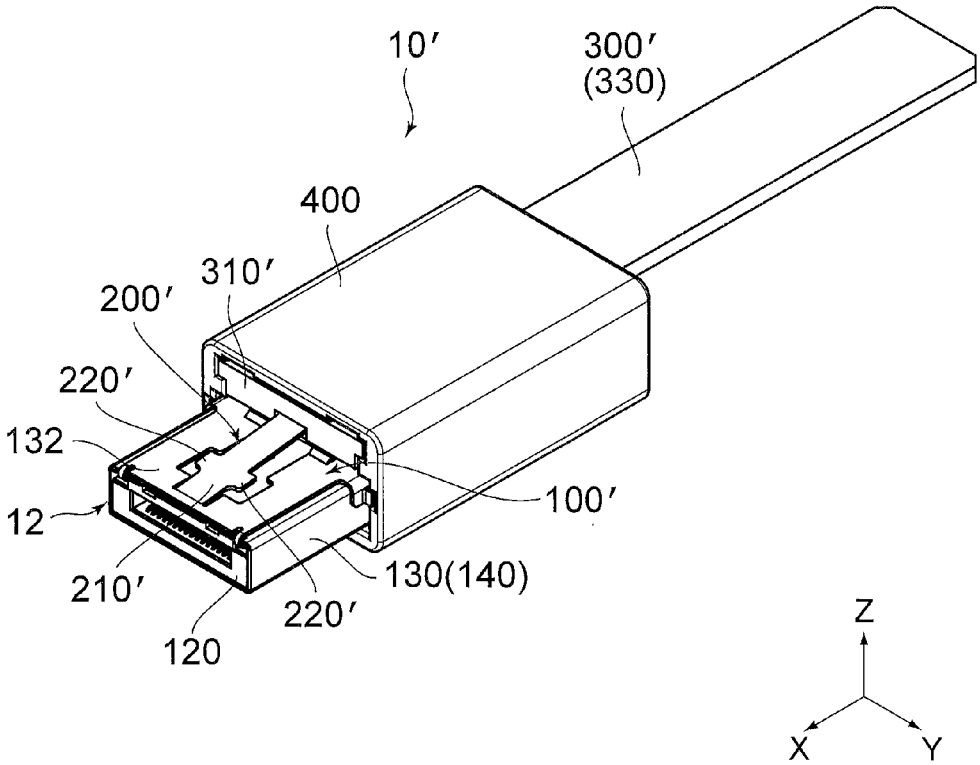
FIG. 15 is a perspective view showing a connector according to a modification of the above-mentioned embodiment of FIG. 1.
Figure 16:
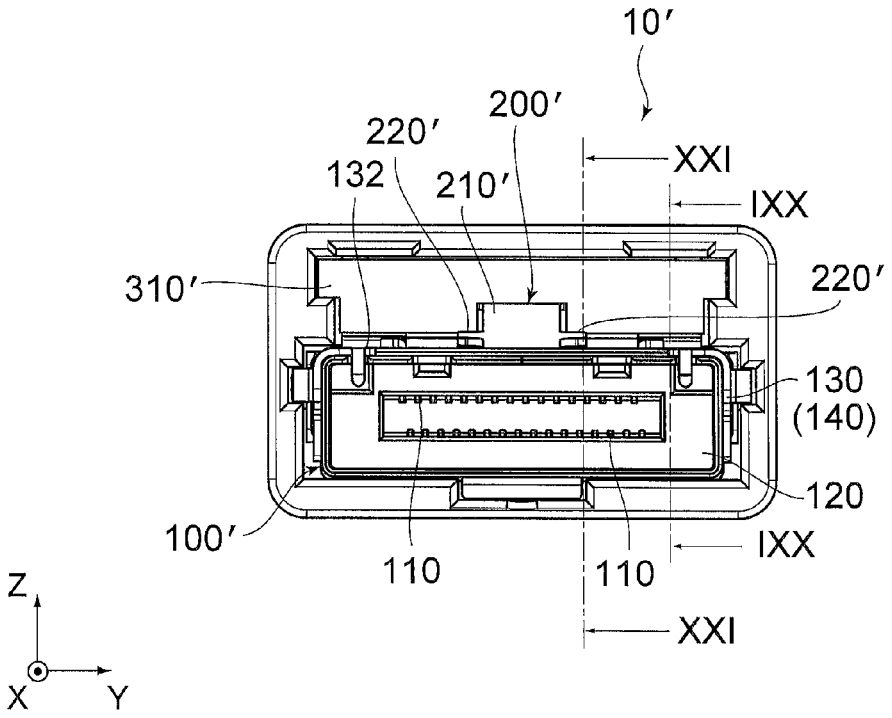
FIG. 16 is a front view showing the connector of FIG. 15.
Figure 17:
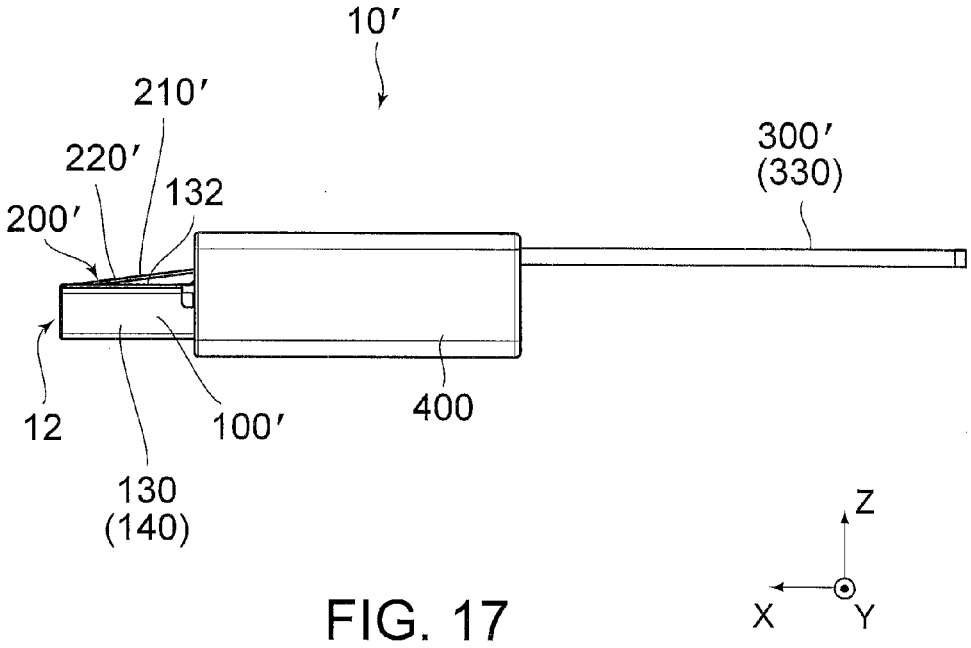
FIG. 17 is a side view showing the connector of FIG. 15.

As shown in FIGS. 12 to 14, the tab 300 includes a movable member 310 and a pulled portion 330. The movable member 310 forms a front end portion of the tab 300. The pulled portion 330 extends rearwards from the movable member 310. In the present embodiment, the movable member 310 and the pulled portion 330 are made of materials same as each other and are formed integrally with each other.

Figure 4:
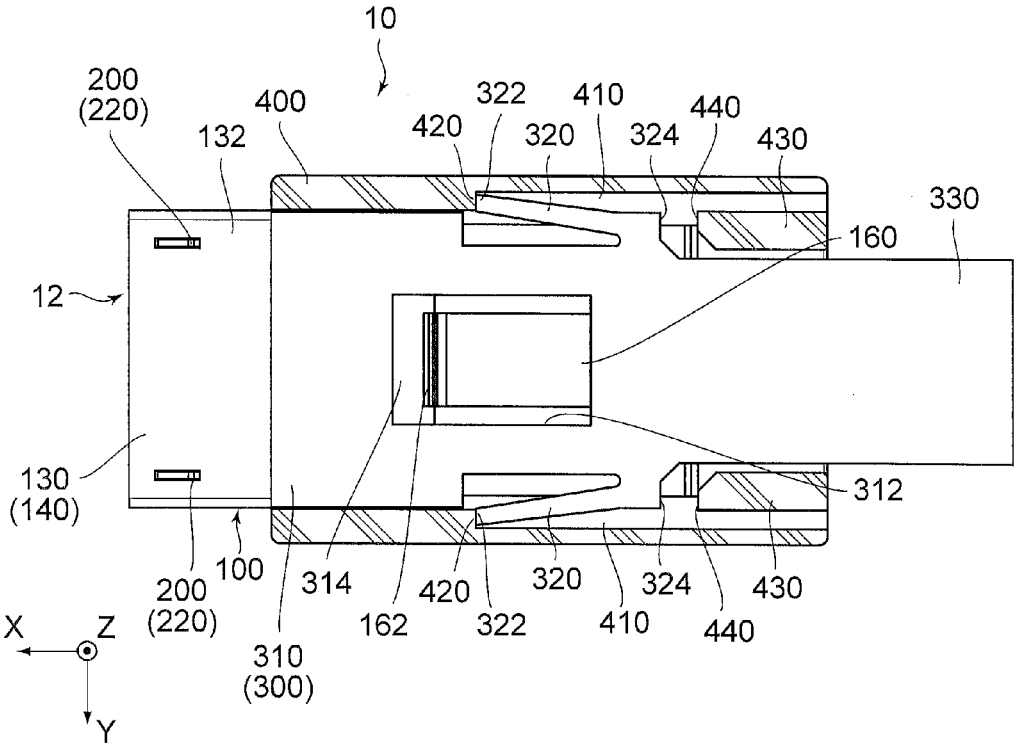
FIG. 4 is a cross-sectional view showing the connector of FIG. 3, taken along line IV-IV. The illustrated connector includes a movable member, which is positioned at a non-operation position.
Figure 5:
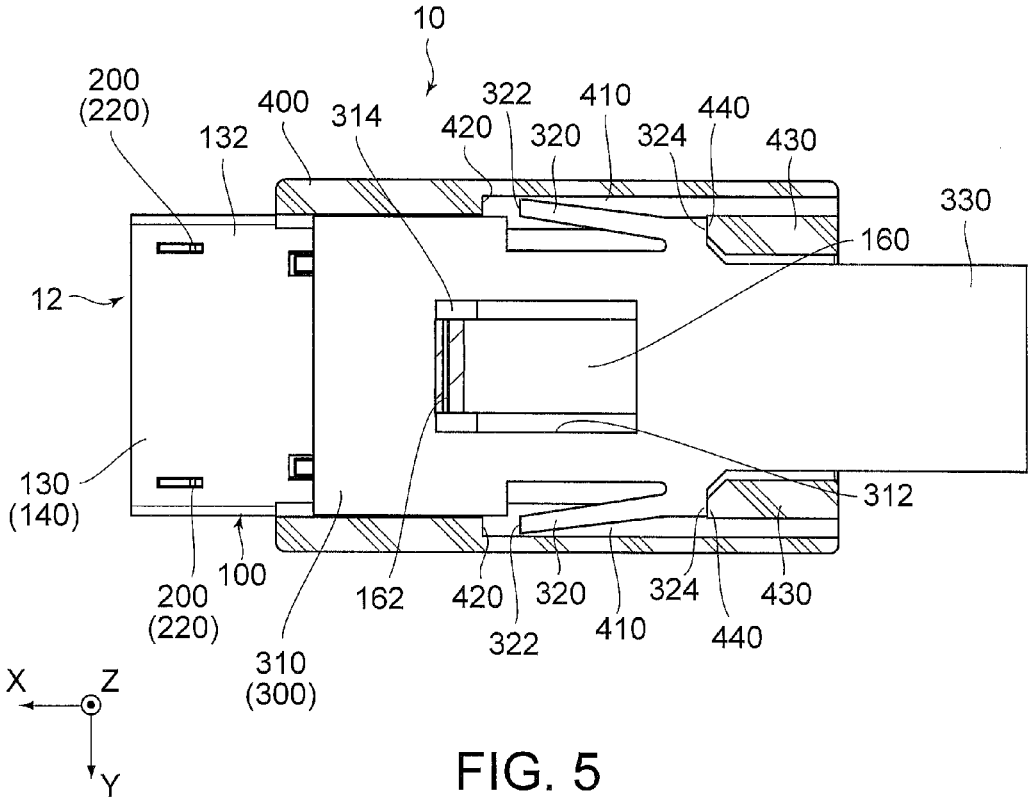
FIG. 5 is another cross-sectional view showing the connector of FIG. 4. The illustrated movable member is positioned at an operation position.

As shown in FIGS. 4 and 5, the movable member 310 is accommodated within the hood 400, while the pulled portion 330 extends outwards of the hood 400. Thus, pulling of the pulled portion 330 rearwards can result in a rearward movement of the movable member 310. The pulled portion 330 may be replaced with a tape or a string which can move the movable member 310 when pulled. The pulled portion 330 may have a different shape or structure, ex. a shape with a finger hole, even if the pulled portion 330 is formed integrally with the movable member 310 as in the present embodiment.

As shown in FIGS. 13 and 14, the movable member 310 is formed with an opening 312. A front wall of the opening 312 has a slope that extends diagonally upwards and forwards, or in the positive Z-direction and in the positive X-direction, and serves as a pressed portion (pressed surface) 314. Thus, the pressed portion 314 intersects the front-rear direction. Although the number of the pressed portion 314 is one same as the number of the spring portion 160 in the present embodiment, a plurality of pressed portions 314 may be arranged in parallel with each other. Even if the number of the spring portions 160 is two or more, the number of the pressed portion 314 may be one, provided that the pressed portion 314 are pressed by the spring portions 160. Alternatively, if the number of the spring portions 160 is two or more, the number of the pressed portions 314 may be equal to the number of the spring portions 160.

With reference to FIGS. 13 and 14, operation portions 316 are provided on the outside of the pressed portion 314 in the width direction. Each of the operation portions 316 of the present embodiment is a slope that extends diagonally downwards and forwards, or in the negative Z-direction and in the positive X-direction. The operation portions 316 operate the operated portions 230 of the lock members 200, respectively, when the movable member 310 is moved rearwards.

As shown in FIGS. 12 and 13, the movable member 310 is further formed with two jutting portions 320. Each of the jutting portions 320 extends from its rear end 324 to its front end 322 diagonally forwards and outwards in the width direction.

As shown in FIGS. 4 and 5, the hood 400 is formed with slot portions 410, each of which is recessed or depressed outwards in the width direction and extends along the front-rear direction. The hood 400 is further formed with stoppers 430 which correspond to the slot portions 410, respectively. Each of the stoppers 430 is positioned inwards of the corresponding slot portion 410 in the width direction and rearwards of the corresponding slot portion 410.

The jutting portions 320 are partially accommodated within the slot portions 410, respectively, so that the movement of the movable member 310 in the front-rear direction is guided. A part of each of the jutting portions 320, which is accommodated within the slot portion 410, has a size in the front-rear direction or the X-direction larger than another size of the slot portion 410 in the up-down direction or the Z-direction. Therefore, swinging of the movable member 310 in the up-down direction is reduced. Therefore, the movable member 310 can be prevented from being rattled even when a force is applied to the pulled portion 330 along the up-down direction.

As shown in FIG. 4, when the front ends 322 of the jutting portions 320 are brought into abutment with front walls of the slot portions 410, or forward positioning portions 420, respectively, the movable member 310 is positioned at its forward limit position. The forward limit position of the movable member 310 is a non-operation position. On the other hand, as shown in FIG. 5, when the rear ends 324 of the jutting portions 320 are brought into abutment with front walls of the stoppers 430, or rearward positioning portions 440, respectively, the movable member 310 is positioned at its rearward limit position. The rearward limit position of the movable member 310 is an operation position. Thus, the movable member 310 of the present embodiment is movable between the non-operation position and the operation position in the front-rear direction, wherein the non-operation position is defined by the front ends 322 of the jutting portions 320 and the forward positioning portions 420 arranged within the hood 400, while the operation position is defined by the rear ends 324 of the jutting portions 320 and the rearward positioning portions 440 arranged within the hood 400. In addition, as apparent from FIGS. 4 and 5, the operation position is positioned rearwards of the non-operation position.

Figure 6:
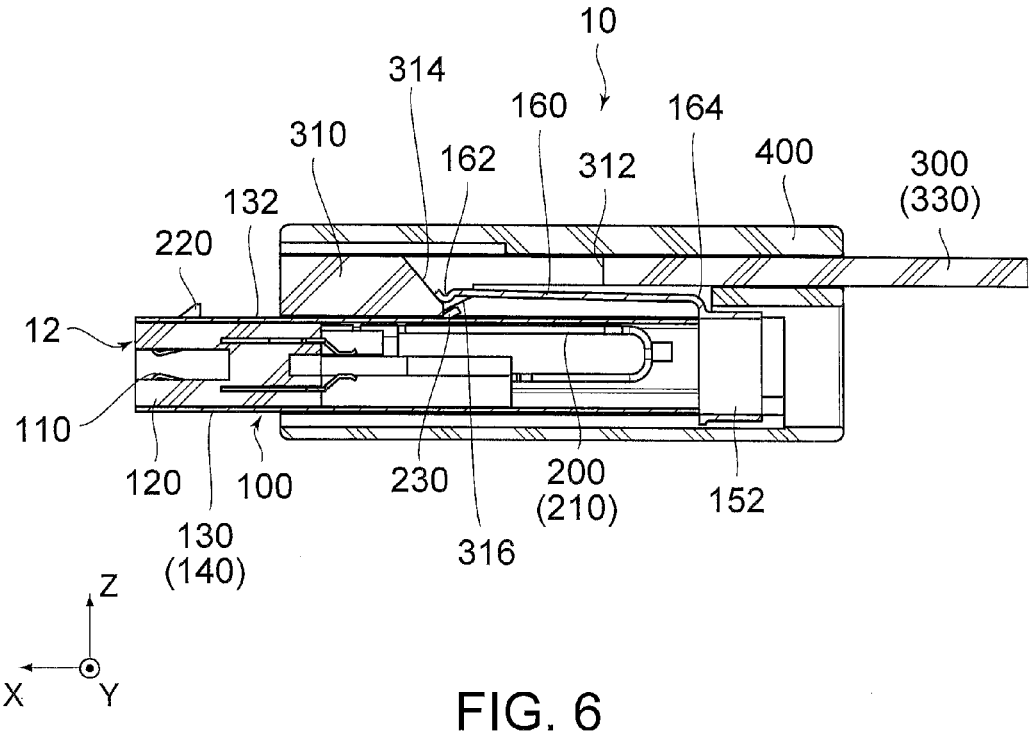
FIG. 6 is a cross-sectional view showing the connector of FIG. 2, taken along line VI-VI. The illustrated movable member is positioned at the non-operation position.

As shown in FIGS. 1 to 4, 6 and 8, the movable member 310 is positioned at the non-operation position under its initial state. As shown in FIG. 6, under the initial state, the spring portion 160 is not deformed, and the front end 162 of the spring portion 160 is positioned close to a lower end of the pressed portion 314. At that time, the operated portions 230 do not receive the respective forces from the operation portions 316, as shown in FIG. 8. Therefore, the lock portions 220 are positioned at their lock positions and project upwards beyond the upper surface 132 of the shield member 130.

During the mating of the connector 10 with the mating connector (not shown), the lock portions 220 are pressed by parts of the mating connector to be moved to the unlock positions for the mean time and, then, return back to the lock positions to lock the mating in cooperation with the locked portions (not shown) of the mating connector. Namely, when the mating is locked, the lock portions 220 are under their initial state. In the meantime, the movable member 310 of the tab 300 does not receive any force, while only the lock members 200 are deformed resiliently. Thus, the movable member 310 of the tab 300 does not receive a load.

The mating of the connector 10 with the mating connector (not shown) can be performed by pushing the connector 10 towards the mating connector while holding the hood 400 or holding the pulled portion 330 of the tab 300.

Figure 7:
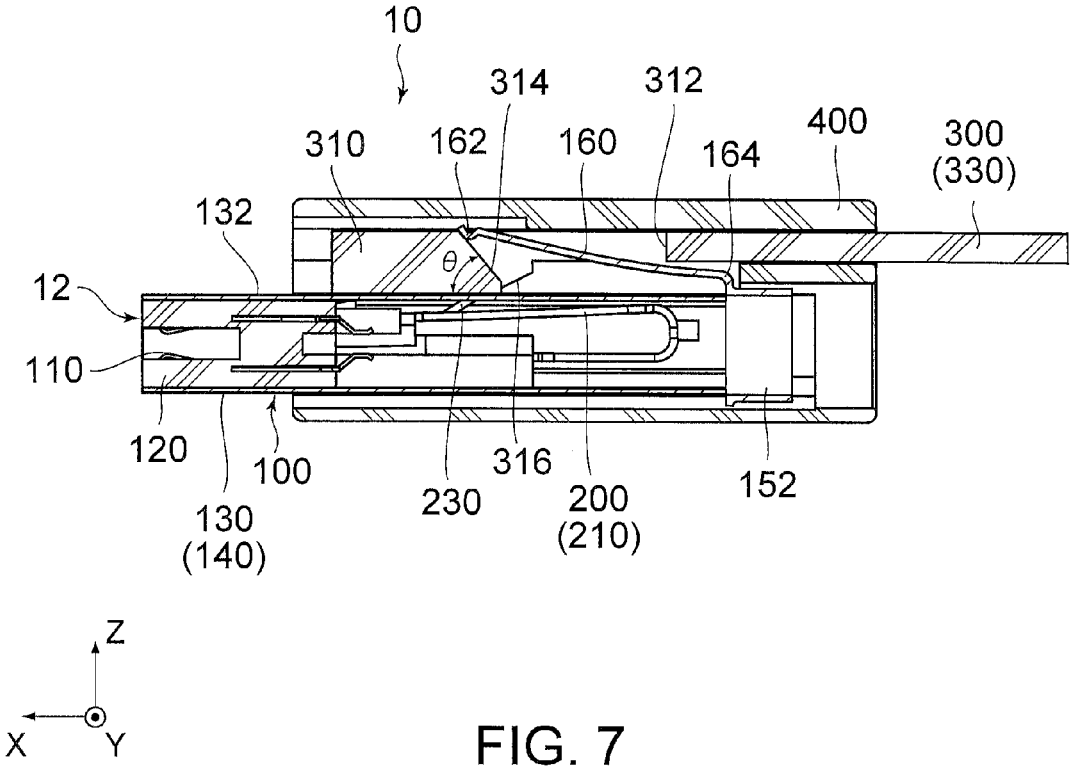
FIG. 7 is another cross-sectional view showing the connector of FIG. 6. The illustrated movable member is positioned at the operation position.

When the pulled portion 330 is pulled rearwards so that the movable member 310 is moved rearwards to the operation position, as shown in FIGS. 5 and 7, the front end 162 of the spring portion 160 runs on the pressed portion 314, and the spring portion 160 is deformed resiliently. Based on the resilient deformation of the spring portion 160, the front end 162 of the spring portion 160 applies the pressed portion 314 with a force diagonally downwards and forwards, or in the positive X-direction and in the negative Z-direction. Since the jutting portions 320 and the slot portions 410 regulate the movement of the movable member 310 in the up-down direction, the movable member 310 is urged to be moved forwards. Specifically, the spring portion 160 presses the movable member 310 forwards.

In order that the front end 162 of the resiliently-deformed spring portion 160 surely presses the pressed portion 314 forwards when the movable member 310 is moved to the operation position, the pressed portion 314 preferably makes, with the front-rear direction, an angle not smaller than 45 degrees but smaller than 90 degrees (See FIG. 7).

With also reference to FIG. 9, when the movable member 310 is moved to the operation position, the operated portions 230 are pressed by the respective operation portions 316 moving rearwards and move downwards. Specifically, when the movable member 310 is moved from the non-operation position to the operation position, the operated portions 230 are moved below the lower surface 318 of the movable member 310. The downward movements of the operated portions 230 cause the lock portions 220 to be moved to their unlock positions. In other words, when the movable member 310 is positioned at the operation position, the lock portions 220 are positioned on the same level as or below the upper surface 132 of the shield member 130. When the movable member 310 is moved to the operation position under the mating state of the connector 10 with the mating connector (not shown), the connector 10 can be released from the mating connector. Specifically, in this embodiment, continuously pulling of the pulled portion 330 can result in detachment of the connector 10 from the mating connector (not shown).

While the pulled portion 330 is pulled, the spring portion 160 continues to press the movable member 310 forwards, as described above. When the pulled portion 330 is released, the movable member 310 is moved forwards to return to the non-operation position. Thus, the operations of the operation portions 316 on the operated portions 230 are released.

Although the present invention is explained above in detail with the connector 10 of one of embodiments, the present invention is not limited thereto.

Although the shield member 130 is formed of two members, i.e. the main section 140 and the subsection 150, in the aforementioned embodiment, the shield member 130 may be formed of a single member.

Although the spring portion 160 is formed integrally with the subsection 150 of the shield member 130 in the aforementioned embodiment, the spring portion 160 may be formed on the main section 140 of the shield member 130 or may be formed separate from the shield member 130, i.e. the main section 140 and the subsection 150.

Although the above-described spring portion 160 is formed of a single plate spring, the spring portion 160 may be formed of two or more plate springs arranged in parallel with each other. The spring portion 160 may be arranged on the outside of the main section 140 not in the up-down direction but in the width direction.

Although the above-described pressed portion 314 is a slop intersecting the front-rear direction, the pressed portion 314 may be a gently-curved concave or another shaped section, provided it intersects the front-rear direction.

Although the above-described two lock members 200 are separated from each other, the lock members 200 are formed integrally with each other from a single metal plate. For example, such lock members 200 are coupled with each other by a coupling section.

Although the lock portions 220 and the operated portions 230 project upwards, or in the positive Z-direction, in the above-mentioned embodiment, they may project outwards in the width direction, or the Y-direction.

Although the operated portions 230 are wholly positioned below the lower surface 318 of the movable member 310 when the lock portions 220 are positioned at their unlock positions in the aforementioned embodiment, the present invention is not limited thereto. For example, when the lock portions 220 are positioned at their unlock positions, parts of the operated portions 230 may be positioned rearwards of the operation portions 316.

Provided that the movements of the operation portions 316 in the front-rear direction operate the operated portions 230 so that the lock portions 220 can be moved to their unlock positions, the operation portions 316 and the operated portions 230 may have different shapes than those of the aforementioned embodiment. For example, each of the operated portions 230 may have a mountain-like shape or may be a rounded protrusion. Each of the operation portions 316 may be a curved surface or a corner at a boundary between two surfaces, wherein the corner forms a straight line extending in the width direction.

Although the movable member 310 of the aforementioned embodiment is formed with the opening 312, the movable member 310 may be provided with a depression which is formed in the lower surface 318 of the movable member 310 and is depressed upwards, instead of the opening 312, if the movable member 310 is thicker or has a larger size in the up-down direction.

Although the front ends 322 and the rear ends 324 of the jutting portions 320 are brought into abutment with the forward positioning portions 420 and the rearward positioning portions 440 in the aforementioned embodiment, portions other than the jutting portions 320 may be brought into abutment with the forward positioning portions 420 and the rearward positioning portions 440 so that the movement of the movable member 310 in the front-rear direction is defined. Even in that case, the jutting portions 320 prevent the movable member 310 from swinging in the up-down direction and guide the movement of the movable member 310 in the front-rear direction.

Although the resilient supporters 210 of the lock members 200 have the front ends as free ends while the lock portions 220 are arranged at the free ends in the above-described embodiment, the present invention is not limited thereto. A resilient supporter of a lock member may have a front end as a fixed end and a rear end as a free end, and a lock portion may be supported by the resilient supporter.

Such modification will be explained hereinafter, with reference to FIGS. 15 to 22. In FIGS. 15 to 22, illustrated components or portions same as or similar to those of the above-mentioned connector 10 are depicted with numeral references same as those used in FIGS. 1 to 14; detail explanation thereabout will be omitted.

With reference to FIGS. 15 to 22, a connector 10' according to the present modification comprises a connector main 100', a tab 300' made of insulator and the hood (holder member) 400 made of insulator.

Figure 18:
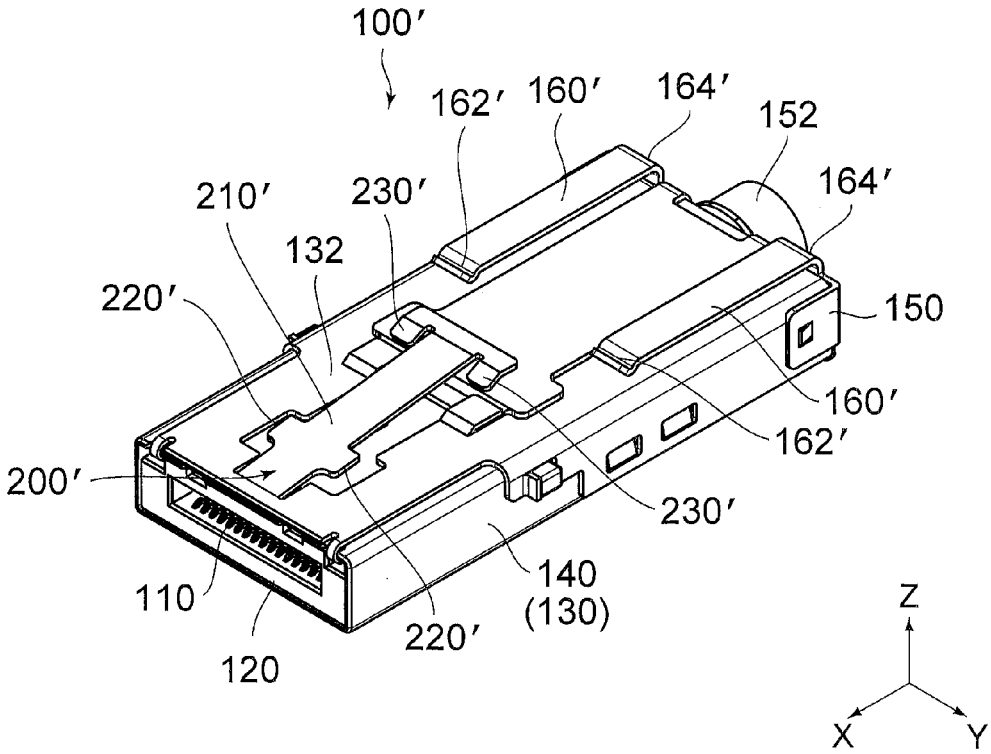
FIG. 18 is a perspective view showing a connector main which is included in the connector of FIG. 15.
Figure 19:
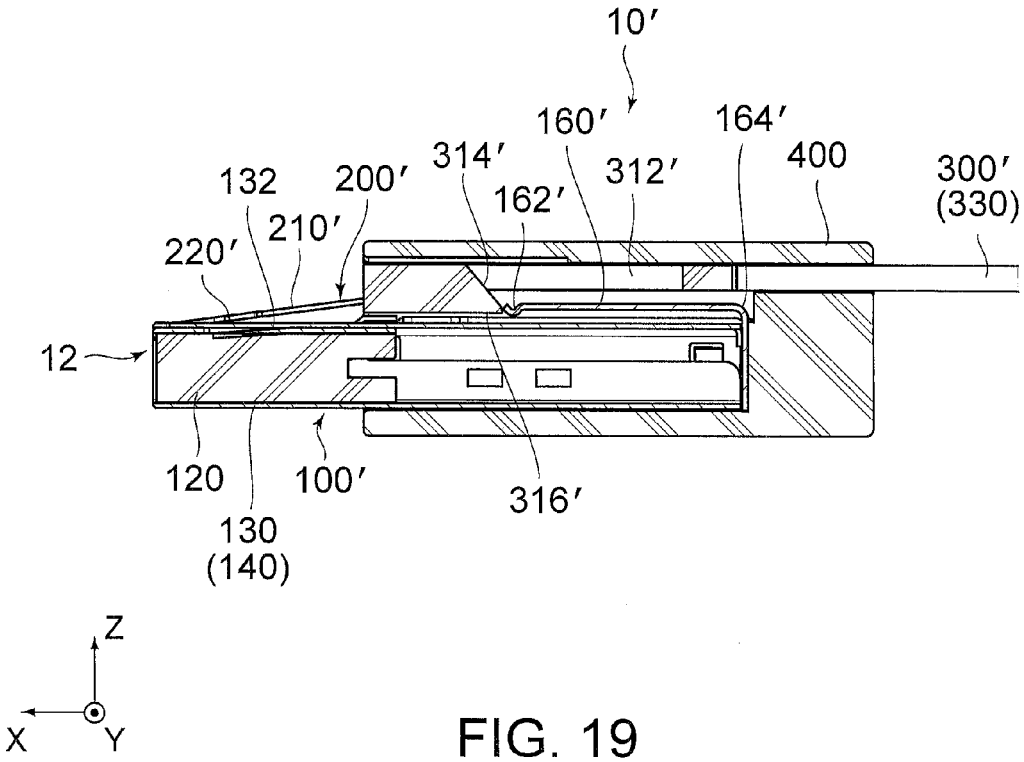
FIG. 19 is a cross-sectional view showing the connector of FIG. 16, taken along line IXX-IXX. The illustrated connector includes a movable member, which is positioned at a non-operation position.

As shown in FIG. 18, a single lock member 200' and two spring portions 160' are attached to the shield member 130 of the connector main 100'. The spring portions 160' are arranged apart from each other in the width direction, or the Y-direction.

Although the number of the spring portions 160' is two, each of the spring portions 160' has a front end 162' as a free end and a rear end 164' as a fixed end, similar to the above-described embodiment. Namely, the front end 162' of each spring portion 160' is movable.

Unlike the above-described embodiment, the lock member 200' includes a single plate-like resilient supporter 210' which has a front end of a fixed end and a rear end of a free end. The lock member 200' is further provided with lock portions 220' and operated portions 230'. Each of the lock portions 220' projects outwards from the resilient supporter 210' in the width direction. Each of the operated portions 230' is also positioned outwards of the resilient supporter 210' in the width direction. The lock portions 220' are positioned forwards of the operated portions 230'. When the operated portions 230' are operated to be moved downwards, the lock portions 220' can be also moved downwards (See FIGS. 21 and 22).

As understood from FIGS. 19 to 22, a movable member 310' of the tab 300' of the present modification is formed with two openings 312', two pressed portions 314' and two operation portions 316'. The openings 312' and the pressed portions 314' correspond to two spring portions 160'. The operation portions 316' correspond to the single lock member 200'. Each of the pressed portions 314' is a slope extending diagonally upwards and forwards. Each of the operation portions 316' is a slope extending diagonally downwards and forwards.

In the connector 10' of this modification, when the tab 300' is pulled, hooking of the lock portions 220' on locked portions (not shown) of a mating connector (not shown) can be released, similar to the aforementioned embodiment.

Figure 20:
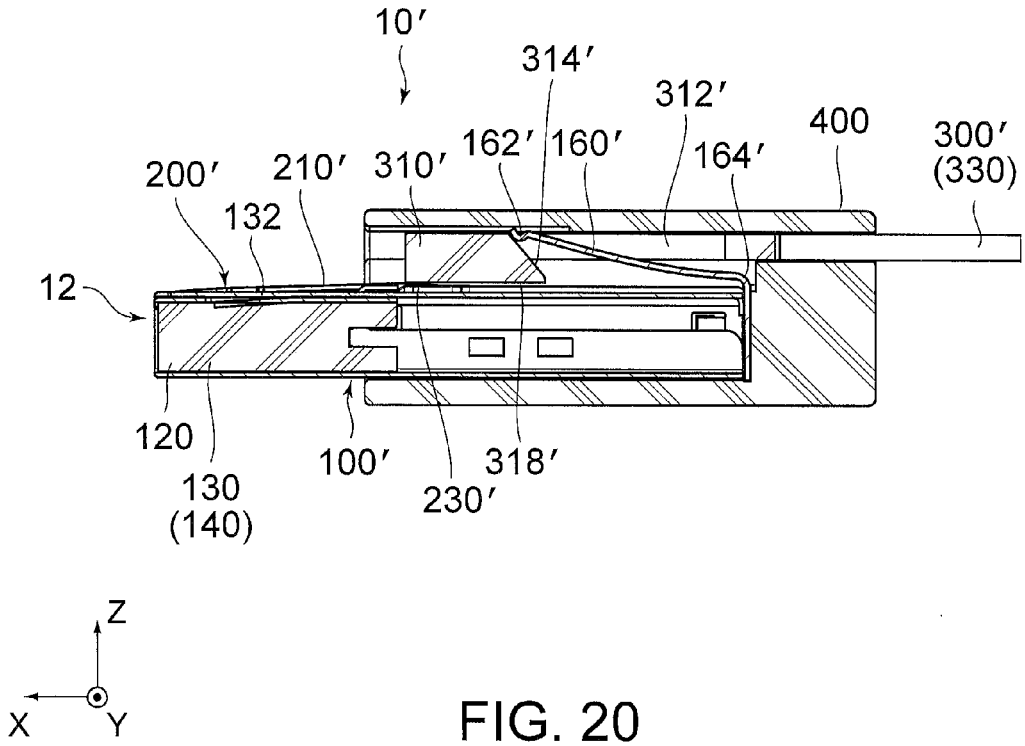
FIG. 20 is another cross-sectional view showing the connector of FIG. 19. The illustrated movable member is positioned at an operation position.
Figure 21:
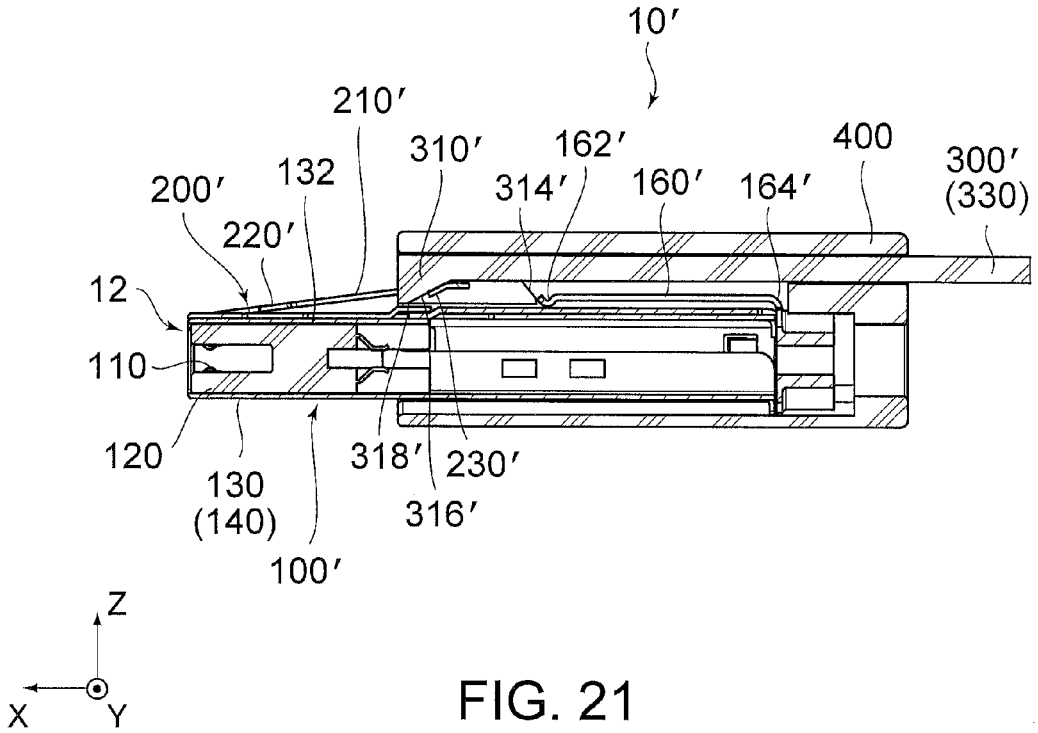
FIG. 21 is a cross-sectional view showing the connector of FIG. 16, taken along line XXI-XXI. The illustrated movable member is positioned at the non-operation position.

Specifically, when the pulled portion 330' is pulled rearwards to be moved to its operation position, as shown in FIG. 20, the front ends 162' of the spring portions 160' run on the pressed portions 314' so that the spring portions 160' are deformed resiliently. Based on the resilient deformation of the spring portions 160', the front ends 162' of the spring portions 160' apply the pressed portions 314' with the respective forces diagonally downwards and forwards, or in the positive X-direction and in the negative Z-direction. Thus, the movable member 310' is pressed substantially forwards, or in the positive X-direction.

Figure 22:
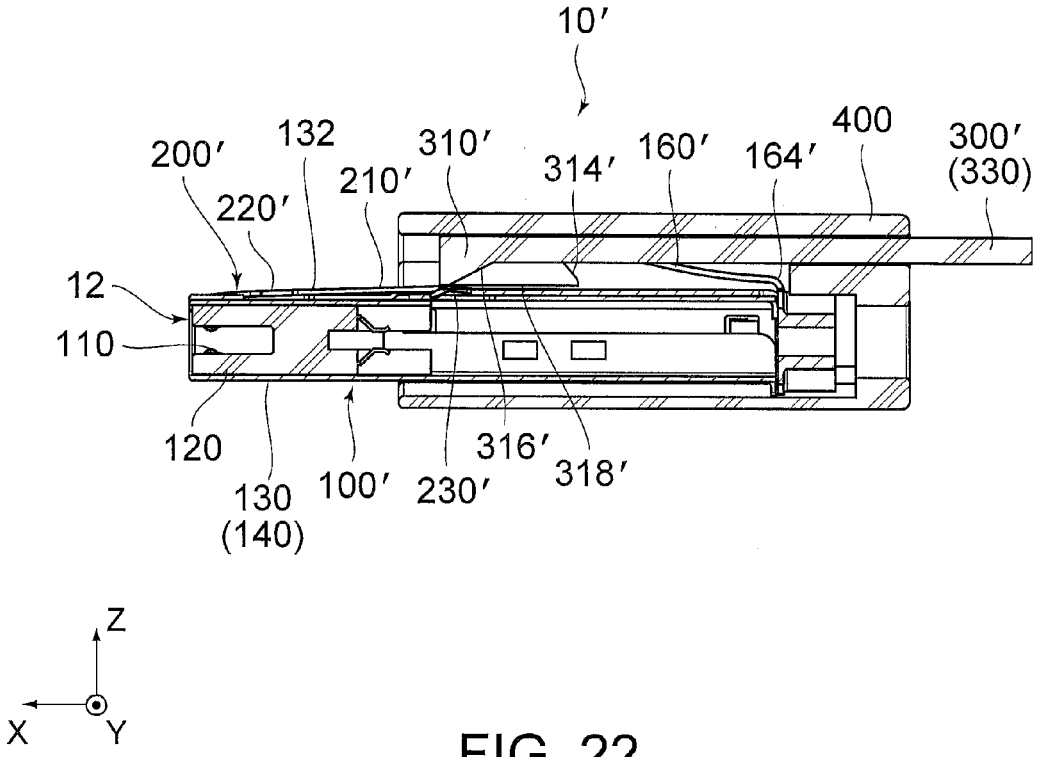
FIG. 22 is another cross-sectional view showing the connector of FIG. 21. The illustrated movable member is positioned at the operation position.
Figure 23:
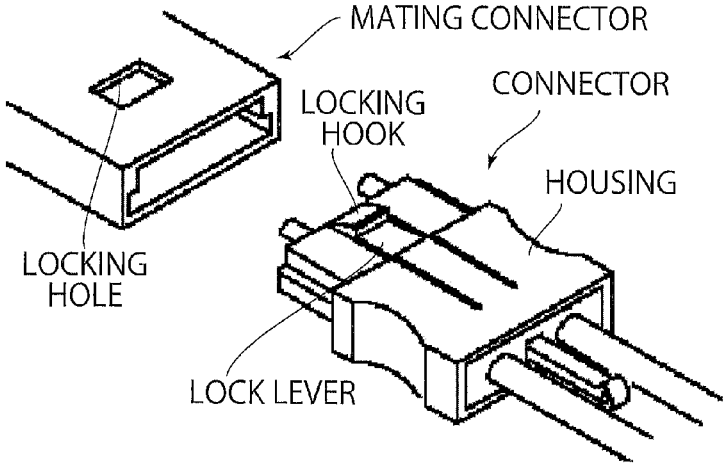
FIG. 23 PRIOR ART
FIG. 23 is a perspective view showing a connector and a mating connector of JP A 2005-235545.
Figure 24:
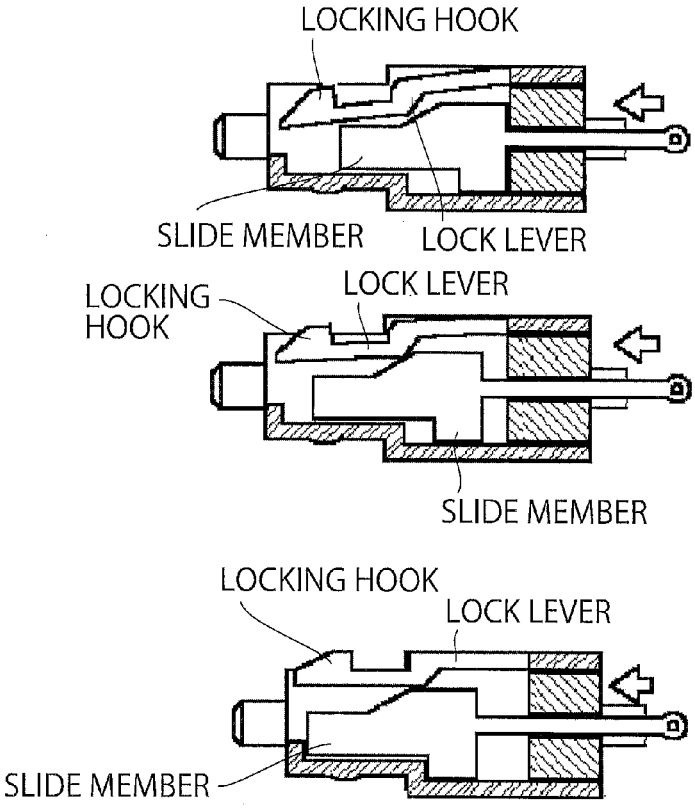
FIG. 24 PRIOR ART
FIG. 24 is a cross-sectional view showing the connector of JP A 2005-235545.

With reference also with FIG. 22, when the movable member 310' is moved to the operation position, the operated portions 230' receive forces from the operation portions 316' moved rearwards and are moved downwards. In particular, upon the movement of the movable member 310' from its non-operation position to its operation position, the operated portions 230' are moved below the lower surface 318' of the movable member 310', as understood from FIGS. 21 and 22. The downward movements of the operated portions 230' cause the lock portions 220' to be moved from their lock positions (See FIG. 21) to their unlock positions (See FIG. 22). Specifically, the lock portions 220' are moved to positions where the lock portions 220' are arranged along the upper surface 132 of the shield member 130. When the movable member 310' is moved to the operation position under the mating state of the connector 10' with the mating connector (not shown), the connector 10' can be released from the mating connector.

While the pulled portion 330' is pulled, the spring portions 160' continue to press the movable member 310' forwards, as described above. When the pulled portion 330' is released, the movable member 310' is moved forwards to return to the non-operation position. Thus, the operations of the operation portions 316' on the operated portions 230' are released.

The present application is based on a Japanese patent application of JP2012-285503 filed before the Japan Patent Office on Dec. 27, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a spring portion, a lock member and a movable member, wherein:

the spring portion has a front end and a rear end in a front-rear direction;

the front end is a free end, while the rear end is a fixed end;

the lock member includes a lock portion and an operated portion;

the lock portion is movable between a lock position and an unlock position;

the lock portion is moved when the operated portion is operated;

the lock portion locks mating of the connector with a mating connector when the lock portion is positioned at the lock position;

the lock portion allows the connector to be released from the mating connector when the lock portion is positioned at the unlock position;

the movable member is movable between an operation position and a non-operation position in the front-rear direction;

the movable member includes a pressed portion intersecting to the front-rear direction and an operation portion for operating the operated portion;

the operation position is rearward of the non-operation position;

when the movable member is forced to be moved rearward from the non-operation position to the operation position, the operation portion operates the operated portion to move the lock portion from the lock position to the unlock position;

when the movable member is held at the operation position, the front end of the spring portion presses the pressed portion to move the movable member towards the non-operation position; and when the movable member is released, the movable member is moved back from the operation position to the non-operation position so that the operation portion stops operating the operated portion and the stopping moves the lock portion back to the lock position.

2. The connector as recited in claim 1, further comprising:

a connector main provided with the lock member and the spring portion; and a holder member holding the connector main so as not to allow a relative movement of the connector main to the holder member, the holder member holding the movable member so as to allow a relative movement of the movable member to the holder member in the front-rear direction.

3. The connector as recited in claim 2, wherein:

the connector main comprises a plurality of contacts, a housing holding the plurality of contacts and a shield member covering, at least in part, the housing; and the spring portion is positioned outside of the shield member.

4. The connector as recited in claim 3, wherein:

the shield member has a predetermined surface;

the spring portion is positioned close to the predetermined surface; and when the lock portion is positioned at the lock position, the lock portion and the operated portion project, at least in part, out of the shield member beyond the predetermined surface.

5. The connector as recited in claim 3, wherein the spring portion is formed integrally with the shield member.

6. The connector as recited in claim 2, wherein the holder member includes a forward positioning portion and a rearward positioning portion, the forward positioning portion defining, as the non-operation position, a forward movement limit of the movable member in the front-rear direction, the rearward positioning portion defining, as the operation position, a rearward movement limit of the movable member in the front-rear direction.

7. The connector as recited in claim 2, wherein:

the holder member is formed with a slot portion which extends in the front-rear direction and is depressed outwards in a width direction perpendicular to the front-rear direction;

the movable member includes a jutting portion which is received, at least in part, by the slot portion;

a part of the jutting portion received by the slot portion has a first size in the front-rear direction;

the slot portion has a second size in an up-down direction perpendicular both to the front-rear direction and the width direction; and the first size is larger than the second size.

8. The connector as recited in claim 2, wherein:

the connector further comprises a pulled portion which extends from the movable member rearwards and outwards of the holder member; and when the pulled portion is pulled rearwards, the movable member is moved from the non-operation position to the operation position.

9. The connector as recited in claim 8, wherein the pulled portion and the movable member are made of materials same as each other and are formed integrally with each other.

10. The connector as recited in claim 1, wherein the pressed portion of the movable member forms an angle of 45 degrees or more with respect to the front-rear direction.

11. The connector as recited in claim 1, wherein:

the lock member includes a resilient supporter supporting the lock portion; and the resilient supporter biases the lock portion so as to move the lock portion towards the lock position.

* * * * *